US006971533B2

(12) United States Patent
Reutter

(10) Patent No.: US 6,971,533 B2
(45) Date of Patent: Dec. 6, 2005

(54) SEALING CAP FOR A MOTOR VEHICLE RADIATOR

(76) Inventor: Heinrich Reutter, Theodor-Heuss-Strasse 12, 71336, Waiblingen (DE)

( * ) Notice: Subject to any disclaimer, the term of this patent is extended or adjusted under 35 U.S.C. 154(b) by 301 days.

(21) Appl. No.: 10/312,600

(22) PCT Filed: Jul. 5, 2001

(86) PCT No.: PCT/EP01/07700

§ 371 (c)(1),
(2), (4) Date: May 14, 2003

(87) PCT Pub. No.: WO02/08587

PCT Pub. Date: Jan. 31, 2002

(65) Prior Publication Data

US 2003/0185276 A1 Oct. 2, 2003

(30) Foreign Application Priority Data

Jul. 22, 2000 (DE) ..... 200 12 722 U

(51) Int. Cl.[7] ..... B65D 55/00

(52) U.S. Cl. ..... 220/201; 220/DIG. 32; 374/196

(58) Field of Search ..... 220/201, DIG. 32, 220/DIG. 33, 203.18, 203.19–203.29, 303; 374/146, 145; 73/729.2, 714

(56) References Cited

U.S. PATENT DOCUMENTS

| | | | | | |
|---|---|---|---|---|---|
| 3,047,235 | A | * | 7/1962 | Eshbaugh et al. | 236/92 C |
| 3,284,004 | A | | 11/1966 | MacLennan | |
| 3,358,871 | A | | 12/1967 | Leichner | |
| 3,622,976 | A | * | 11/1971 | Howard | 340/451 |
| 3,700,166 | A | | 10/1972 | Foults | |
| 4,107,493 | A | * | 8/1978 | Nagara et al. | 200/84 C |
| 4,511,056 | A | * | 4/1985 | Reutter | 220/203.02 |
| 4,733,564 | A | * | 3/1988 | Gorge | 73/715 |
| 4,779,755 | A | * | 10/1988 | Harris | 220/203.21 |
| 4,913,303 | A | * | 4/1990 | Harris | 220/203.21 |
| 5,020,685 | A | * | 6/1991 | Sato et al. | 220/203.21 |
| 5,520,300 | A | * | 5/1996 | Griffin | 220/210 |
| 5,907,101 | A | * | 5/1999 | Polti et al. | 73/714 |
| 6,073,791 | A | * | 6/2000 | Reutter | 220/201 |
| 6,273,117 | B1 | * | 8/2001 | McPhee | 137/12 |

FOREIGN PATENT DOCUMENTS

| | | | | |
|---|---|---|---|---|
| DE | 1931736 | | 1/1966 | |
| DE | 2756689 | | 7/1978 | |
| DE | 19753597 | A1 | 6/1999 | |
| EP | 652393 | * | 5/1995 | 220/201 |
| EP | 0995888 | A1 | 4/2000 | |
| FR | 1600373 | | 7/1970 | |
| WO | WO 95/32904 | | 12/1995 | |

* cited by examiner

*Primary Examiner*—Lien Ngo
(74) *Attorney, Agent, or Firm*—Bacon & Thomas

(57) ABSTRACT

A pressure cap for a fixed neck of an automobile radiator is provided with an outer cap component and with an inner cap component which has a flow connection between the inside and the outside of the tank and a valve arrangement for releasing and blocking the flow connection. The invention allows the bias of the pressure-relief valve body to be adjustable while the temperature inside the tank can be measured directly and the action of the pressure-relief/vacuum valve body remains constant, it is provided that the bias with which the pressure-relief valve body is pressed against the sealing seat can be adjusted by means of a thermal drive in the form of an expansion-material membrane capsule which has a temperature sensor that passes through the cap axis and extends into the tank's neck, and it is also provided that the vacuum valve body is arranged eccentrically in relation to the cap axis.

11 Claims, 4 Drawing Sheets

SEALING CAP FOR A MOTOR VEHICLE RADIATOR

FIELD OF THE INVENTION

The present invention relates to a pressure cap for fixed neck of a tank, in particular automobile radiators, provided with an outer cap component, an inner cap component and a valve arrangement. The inner cap component has a flow connection between the inside and the outside of the tank. The valve arrangement releases and blocks the flow connection. For this purpose, the valve arrangement has an axially movable pressure-relief valve body which is pressed against a sealing seat on the inner cap component with a bias controlled by the operating pressure in the tank.

BACKGROUND OF THE INVENTION

In a pressure cap known from DE 197 53 597 A1, the bias of the pressure-relief valve body can be controlled by the operating pressure and adjusted such that a piston-activated toggle or electric lifting magnet acts upon a pressure piece, and where a compression spring is provided between the pressure piece and the pressure-relief valve body. In the former case, the bias depends on the operating pressure of the automobile engine, and in the latter case, on an electric control or the ignition.

It has also been suggested before to control the bias of the pressure-relief valve body depending on the temperature inside the tank. For that purpose, the temperature-dependent control unit in the inner cap component is arranged in a space between the pressure-relief valve body and the outer cap component. This position of the temperature-dependent control element is disadvantageous for measuring and transmitting the temperature prevailing inside the tank because it is relatively far away from the inside of the tank and can therefore measure the temperature prevailing therein only with delay and with a considerable tolerance.

With the two above named types of pressure caps, the valve arrangement is provided with a vacuum valve body which is positioned concentric to and substantially within the pressure-relief valve body.

It is also known from DE 197 53 597 A1 to design the outer cap component with a locking element that can be incorporated in the neck, and a handling element which call be rotated in relation to the neck, whereby between both of these, an anti-rotation means is provided that can be engaged and disengaged. The anti-rotation means is embodied in a place eccentric to the longitudinal axis by a bolt which is loaded with a temperature-dependent bimetal or memory spring. In this case, too, the problem consists of the delayed and imprecise measuring of the temperature conditions inside the tank.

SUMMARY OF THE INVENTION

It is the object of the present invention to create a pressure cap of the type mentioned above for a fixed neck of a tank, in particular for automobile radiators, in which the bias of the pressure-relief valve body can be adjusted as the temperature inside the tank is measured directly and while the action of the pressure-relief/vacuum valve assembly remains constant.

This objective is achieved with a pressure cap of the type mentioned above for a fixed neck of a tank, in particular for automobile radiators, wherein the bias with which the pressure-relief valve body is pressed against the sealing seat is adjustable by means of a thermal drive in the form of an expansion-material membrane capsule which is provided with a temperature sensor which passes in the direction of the pressure cap axis and extends into the neck of the tank. The vacuum valve body of the valve arrangement is arranged eccentrically with respect to the pressure cap axis.

With the measures according to the invention it is achieved that the temperature-dependent drive element in the form of an expansion element can measure the temperature inside the tank directly and without delay. The temperature conditions inside the tank can be transmitted via the shortest and most direct route along the cap axis without having to accept the disadvantages caused by the effect of the pressure-relief valve body and in particular the effect of the vacuum valve body.

It is practical to provide the vacuum valve body at a distance from the pressure-relief valve body on the floor of the inner cap component. For this purpose the vacuum valve body is arranged on the underside of the inner cap component facing away from the pressure-relief valve body and releasably covers a vacuum channel in the floor of the inner cap component.

A simple holder is provided and the vacuum valve body is supported and arranged in a simple fashion on the floor of the inner cap component. For this purpose the floor of the inner cap component is covered by a further cap by which the vacuum valve body is supported, the vacuum valve body being axially movable against the effect of a compression spring, and the vacuum valve body being formed by an umbrella valve whose middle part is held in a fixed position between the floor of the inside cap component and a further cap and whose umbrella part covers the vacuum channel.

To create an anti-rotation means that reacts immediately and without delay, the outer cap component is provided with a locking element for the tank's neck, and with a handling element which can be rotated in relation to same, characterized in that the membrane capsule acts at one end upon the bias means of the pressure-relief valve body and at the other end upon an anti-rotation means between the handling element and the locking element. With this, it is achieved that the temperature measured immediately by the sensor and transmitted to the expansion element is used for the direct control of the anti-rotation means.

Advantageous embodiments of the anti-rotation means result from the anti-rotation means being on the side facing away from the membrane capsule and being loaded with a compression spring, by the anti-rotation means being formed by a check plate with vertical claws, whereby the check plate is axially movable in relation to the handling element but non-rotatable, and whereby the claws can be engaged in and disengaged from recesses in the locking element, by the membrane capsule being arranged between the check plate of the locking element and an axially movable guidance element between which and the pressure-relief valve body a compression spring is provided, and by the guidance element being surrounded by a temperature sensor in the form of a rod.

Advantageously, the temperature sensor is sealed against the pressure-relief valve body.

BRIEF DESCRIPTION OF THE DRAWINGS

Further details of the invention are described below, where the invention is described in with reference to the embodiments shown in the drawings, where.

DESCRIPTION OF THE PREFERRED EMBODIMENTS

Figure 1:
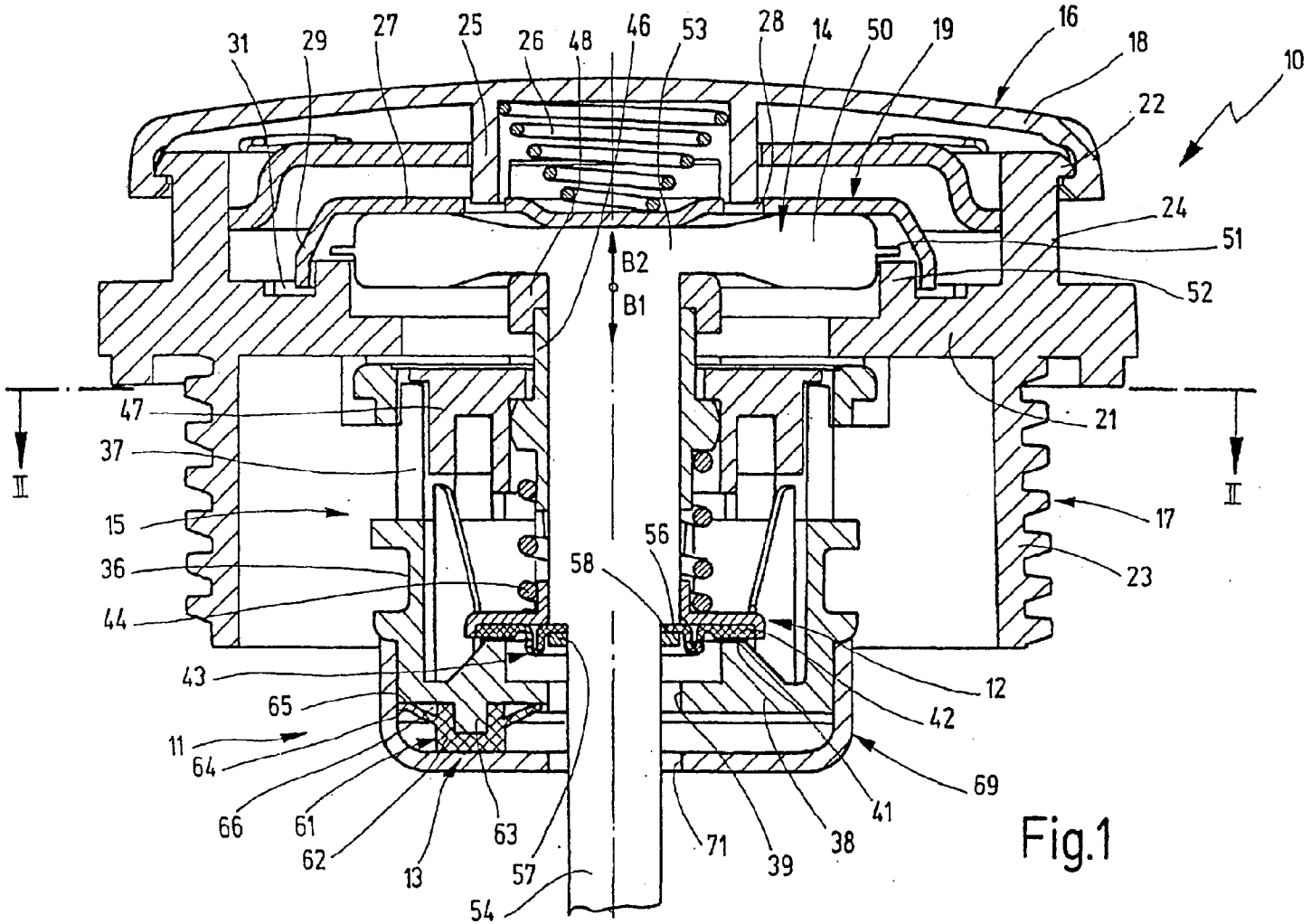
FIG. 1 shows a schematic view of a lengthwise section of a pressure cap for an automobile radiator according to a first embodiment of the present invention.

The pressure cap 10, 110 or 210 shown in the drawings by means of three embodiments is provided with a pressure-relief/vacuum valve assembly 11, 111, 211 which includes an pressure-relief valve body 12 that is the same in all embodiments, and a vacuum valve body 13, 113 and 213, respectively. The opening pressure of pressure-relief valve body 12 can be adjusted in two stages with a thermal drive 14 that is the same in all embodiments, namely to an opening pressure that takes into consideration the automobile radiator overpressure at normal operation, and to an opening pressure that corresponds to the higher automobile radiator overpressure caused by the accumulated heat when the automobile engine is turned off.

According to the drawings, the outer cap component 16 of pressure cap 10, 110, 210, which is the same in all embodiments, has a locking element 17 which in this case consists of a male threaded element for screwing and unscrewing the pressure cap to or from the opening of a neck (not shown) of an automobile radiator or other tank, and a handling element 18 which can be rotated against the locking element 17 and can be non-rotatably connected by means of an anti-rotation means 19 that is the same in all embodiments. It will be appreciated that the locking element 17 can also be designed as a bayonet connection instead of a male threaded element.

According to FIG. 1, the locking element 17 is provided with a diaphragm 21 (with an axial opening) from whose underside a male threaded sleeve 23 extends, and from whose upper side a connecting sleeve 24 extends axially, by whose radial flange 22 the locking element 17 is held rotatable at the handling element 18, but axially suspended and immovable. On the outer edge, the handling element 18 extends under the flange 22 of connecting sleeve 24 of locking element 17 and is provided in the middle with circular guidance fingers 25 which extend axially inside and between which a compression spring 26 is provided which is supported at one end by the inside of handling element 18 and at the other end by a check plate 27 of anti-rotation means 19. Check plate 27 is provided on an annular circumference with slots 28 in which the guidance fingers 27 of anti-rotation means 19 engage, such that check plate 27 of anti-rotation means 19 is anti-rotationally connected with handling element 18. On its outer perimeter, the check plate 27 is provided with claws 29 bent axially downward, which engage in axial grooves 31 of diaphragm 21 of locking element 17 in their initial position according to FIG. 1, such that in this position, the anti-rotation means 19 is non-rotationally connected not only with handling element 18, but also with locking element 17, thus making it possible for the pressure cap 10 to be screwed to or unscrewed from the neck (not shown). As will be shown below, the anti-rotation means 19 is movable against the effect of compression spring 26 such that the claws 29 are disengaged from the grooves 31, such that the anti-rotation between the anti-rotation means 19 and the locking element 17 is eliminated, which leads to the idling of handling element 18 on the locking element 17 and prevents the unscrewing of the pressure cap from the neck.

According to FIG. 1, suspended from the locking element 17 of outer cap component 16 is an inner cap component 15 holding the pressure-relief/vacuum valve assembly 11, such that the inner cap component 15 is axially immovable against the outer cap component 16, but rotatable in circumferential direction. The inner cap component 15 is provided with a valve pot 36 which is suspended from the locking element 17 and has radial flow-through openings 37. The floor (38) of valve pot 36 is provided with a central opening 39 around which is provided an annular sealing surface 41 that is axially higher toward the inside. Bearing directly on this annular sealing surface 41 is the pressure-relief valve body 43—with the radially outer sealing surface 42 of a sealing membrane 43—under the effect of a compression spring 44 whose bias is adjustable. The pressure-relief valve body 12 is approximately hat-shaped, and the sealing membrane 43 is accommodated within its brim which is axially bent down toward the floor (38). At the other end, the compression spring 44 is supported by an axially movable pressure sleeve (46) which faces away from the pressure-relief valve body 12 and is supported by a fixed inner guidance sleeve 47 of inner cap component 15.

The axial pressure sleeve 46 is acted upon via a freely supported pressure ring 48 by the thermal drive 14 which in the embodiments shown is designed as an expansion-material membrane capsule 50. The membrane capsule 50 is arranged between the diaphragm 21 of locking element 17 and the check plate 27 of anti-rotation means 19. An external ring flange 51 of membrane capsule 50 bears on a ring lug 52 of locking element 17. The upper face of the central expandable section 53 of membrane capsule 50 lies on a central indentation of check plate 27, and its underside lies on pressure ring 48. The expansion-material membrane capsule 50 is connected in mid axis with a sensor rod 54 which passes through pressure-relief valve body 12 and is long enough to extend into the fixed neck of the tank or automobile radiator where it can directly measure the temperature prevailing therein. Sensor rod 54 has the effect of a capillary, is closed at its free end and connected inside the tank with membrane capsule 50. Sensor rod 54 is filled with the same expansion material as membrane capsule 50. Held as a seal between a ring shoulder 56 of sensor rod 54 and a fixed washer 57 is the radially inner sealing surface 58 of sealing membrane 43 of pressure-relief valve body 12. In the upper section, sensor rod 54 serves as a guide for pressure sleeve 46 which surrounds it and for pressure ring 48' in the lower section, which has a smaller diameter, sensor rod 54 passes through central opening 39 in valve pot floor 38 such that a concentric annular opening 39 remains.

According to the various embodiments, the vacuum valve body 13, 113, 213 is arranged eccentrically to the longitudinal axis of pressure cap 10, 110, 210, on the underside of the floor 38 of valve pot 36 in a place where the annular section is surrounding the central opening 39.

Figure 2:
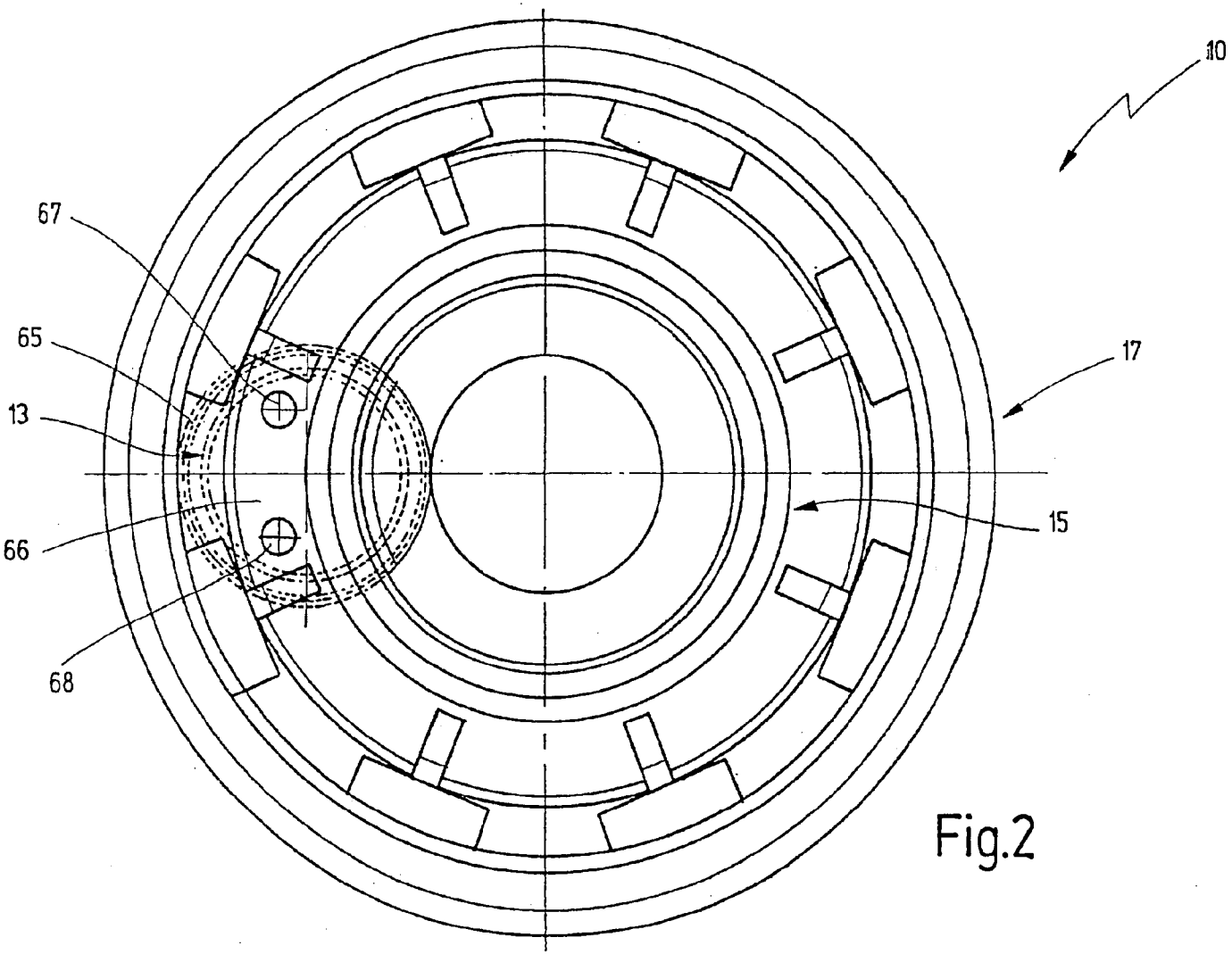
FIG. 2 shows an interior view of the inner cap component without the pressure-relief valve body along line II—II of FIG. 1.

In the embodiment according to FIG. 1, the vacuum valve body 13 is formed as an umbrella valve 61 whose central main section 62 is plugged over a pin which protrudes from the underside of floor 38. The radially outer annular sealing surface 65 of the circular umbrella rim 64 is biased against a sealing surface of the underside of floor 38. As shown in FIG. 2, two connecting channels 67 and 68, which lie opposite each other and pass through floor 38 of valve pot 36, lead into space 66 between the main section 62 and the annular sealing surface 65. Pulled over floor 38 of valve pot 36 is another cap 69 which is held by the inner cap component 15 and which is provided with an axial through-hole 71 around the corresponding section of sensor rod 54 and to whose inside floor the main section 62 of umbrella valve 61 is adjoining.

In case of a vacuum in the tank, umbrella rim 64 with its annular sealing surface 65 lifts off the sealing surface of valve pot floor 38, such that a flow connection results through opening 71 and channels 67, 68 as well as the radial openings 37 toward the outside.

Figure 3:
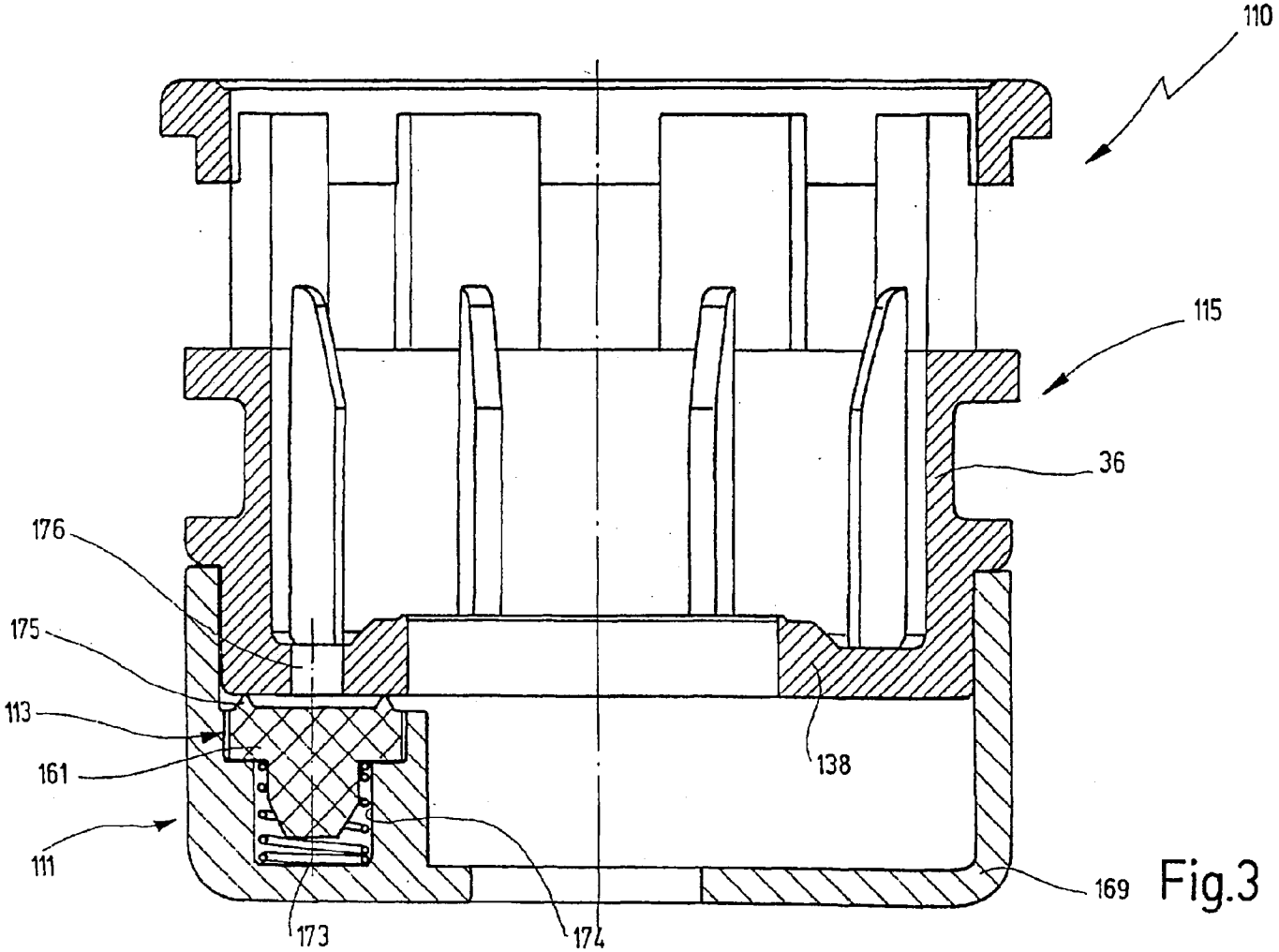
FIG. 3 shows a view corresponding to FIG. 1, but only of the inner cap component, and the vacuum valve body according to a second embodiment of the present invention.

In the embodiment according to FIG. 3, the vacuum valve body 113 is formed by an axially movable body element 161 which is arranged in a stepped blind hole 174 of a cap 169 held at the inner cap component 115. Through the effect of a compression spring 173 inside the stepped blind hole 174, the raised annular sealing surface 175 of valve body element 161 is pressed against a corresponding sealing seat on the underside of floor 138 of valve pot 36, where it acts as a seal. Within the annular sealing surface 175 of valve element 161, at least one through-hole 176 is provided in floor 138 of valve pot 36. In case of a vacuum inside the tank, the body element 161 of vacuum valve body 113 is lifted off the sealing seat on floor 138 against the effect of compression spring 173.

Figure 4:
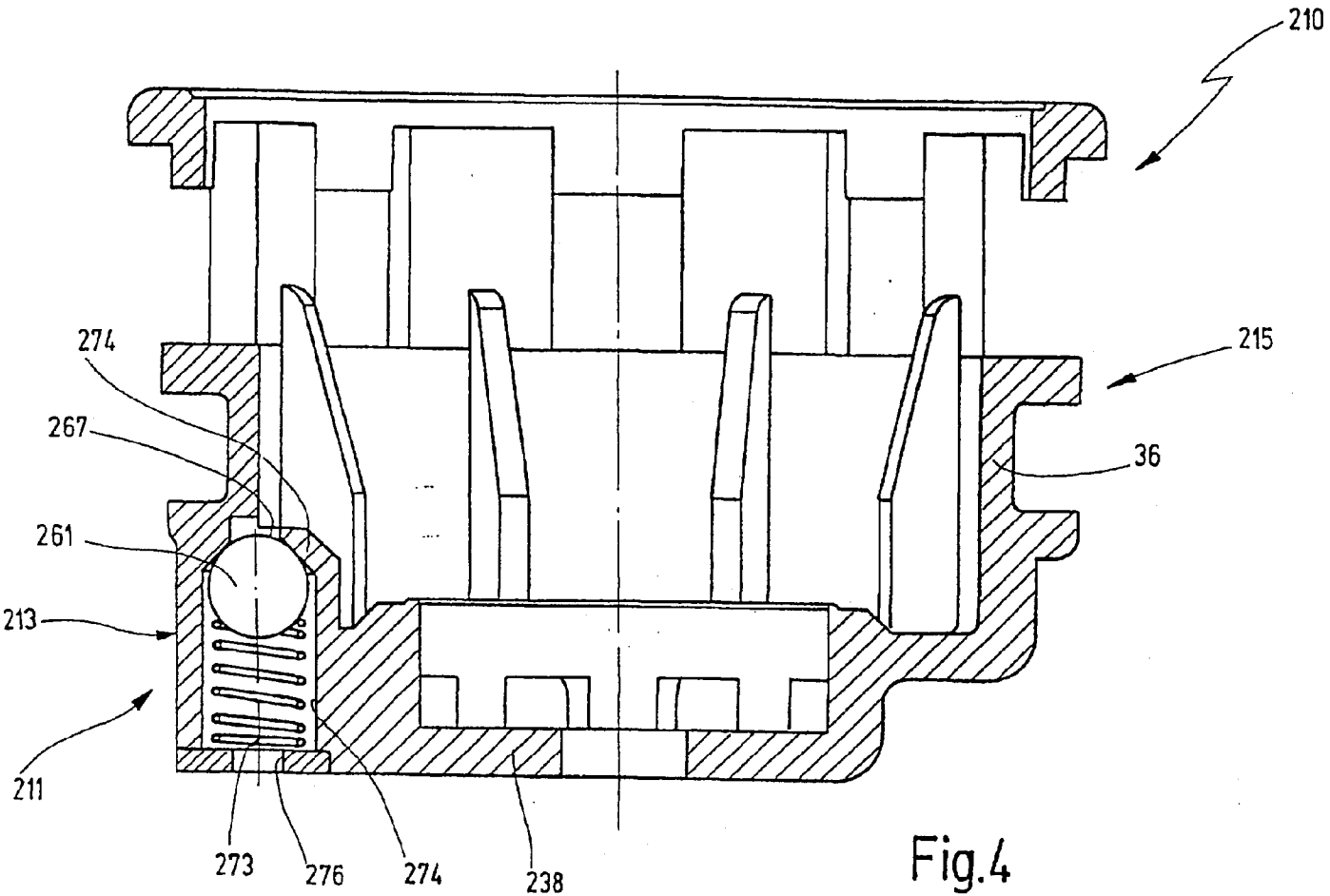
FIG. 4 shows a view corresponding to FIG. 1, but only of the inner cap component, and the vacuum valve body according to a third embodiment of the present invention.

FIG. 4 shows an embodiment of a vacuum valve body 213, in which a ball element 261 is provided which is held within an axial recess 274 in the floor 238 of valve pot 36. The ball element 261 is acted upon by a compression spring 273 such that it is pressed against a sealing seat around a through-channel 267 in the floor of recess 274. On the other end, the undercut recess 274 is also provided with a through-hole 276 around which compression spring 273 is supported. Here, too, in case of a vacuum, the ball element 261 is lifted off the sealing seat against the effect of compression spring 273 to release recess 274.

As FIG. 1 shows, the thermal drive 14 in the form of membrane capsule 50 expands axially in the middle when the engine is running, which has the effect that due to the still excessive force of bias spring 44 of pressure-relief valve body 12, the membrane capsule 50 expands upwards in the direction of Arrow B2, and the anti-rotation means 19 or check plate 27 lifts off so far that its claws 29 come free of the grooves 31 of locking element 17. In that state, the anti-rotational connection between the locking element 17 and the handle element 18 is broken. When the engine is turned off, the temperature continues to rise due to accumulated heat in the tank and is transmitted via the sensor rod 54 to the membrane capsule 50, with the effect that the membrane capsule 50 continues to expand in axial direction. Due to the fact that the membrane capsule 50 adjoins fingers 25 of handling element 18, the membrane capsule 50 expands downward in the direction of Arrow B1 against the effect of compression spring 44 and acts upon pressure ring 48 and the axial pressure sleeve 46, such that the increased biasing force of compression spring 44 causes the opening pressure for the pressure-relief valve 12 to increase to a higher value such as 2.0 bar. In this state, the idling connection between handling element 18 and locking element 17 is maintained as well, since check plate 27 continues to remain in its uppermost position. Only after a complete cool-down is the initial position as shown in FIG. 1 reached again.

What is claimed is:

1. A pressure cap for a fixed neck of a tank in which an operating pressure prevails, the pressure cap defining an axis, comprising:

an outer cap component;

an inner cap component with a flow connection between the inside and outside of the tank and a sealing seat;

a valve arrangement for releasing and blocking said flow connection, said valve arrangement having a vacuum valve body and an axially movable pressure-relief valve body which is pressed toward the inside of the tank against said sealing seat with a bias controlled by the operating pressure, such that when the operating pressure exceeds a threshold value said pressure-relief valve body is lifted off said sealing seat; and a thermal drive, wherein:

said bias is adjusted by said thermal drive formed as an expansion-material membrane capsule provided with a temperature sensor, said temperature sensor passing the direction of the pressure cap axis and extends into the neck of the tank; and said vacuum valve body is arranged eccentrically with respect to the pressure cap axis.

2. The pressure cap according to claim 1, wherein:

a vacuum channel is defined in a floor of said inner cap component;

said vacuum valve body is arranged on the underside the floor of said inner cap component, facing away from said pressure-relief valve body, and releasably covers said vacuum channel.

3. The pressure cap according to claim 2, further comprising:

a further cap, wherein:

said floor of said inner cap component is covered by said further cap by which said vacuum valve body is supported.

4. The pressure cap according to claim 1, further comprising:

a compression spring, wherein:

said vacuum valve body is axially movable against the effect of said compression spring.

5. The pressure cap according to claim 1, wherein:

a vacuum channel is defined in a floor of said inner cap component;

said vacuum valve body is formed as an umbrella valve whose middle part is held in a fixed position between said floor of said inner cap component and said further cap; and the umbrella part of said umbrella valve covers said vacuum channel.

6. The pressure cap according to claim 1, further comprising:

an anti-rotation means, wherein:

said outer cap component includes a locking element for the tank's neck, and a handling element which is rotatable relative to said locking element;

said anti-rotation means is situated between said handling element and said locking element; and said membrane capsule acts at one end upon said bias and at the other end upon said anti-rotation means.

7. The pressure cap according to claim 6, further comprising:

a compression spring, wherein:

said anti-rotational means is loaded with said compression spring on its side facing away from said membrane capsule.

8. The pressure cap according to claim 6, wherein:

said anti-rotation means is formed by a check plate with vertical claws;

said check plate is axially movable relative to said handling element but non-rotatable relative thereto; and said claws are adapted to be engaged in and disengaged from said recesses in said locking element.

9. The pressure cap according to claim 8, further comprising:

an axially movable guidance element; and a compression spring, wherein:

said membrane capsule is arranged between said check plate and said axially movable guidance element; and said compression spring is provided between said membrane capsule; and said pressure-relief valve body.

10. The pressure cap according to claim 9, wherein:

said temperature sensor has the form of a rod; and said guidance element surrounds said temperature sensor.

11. The pressure cap according to claim 10 wherein:

said temperature sensor is scaled against said pressure-relief valve body.

* * * * *